US005913765A

United States Patent [19]

Burgess et al.

[11] Patent Number: 5,913,765

[45] Date of Patent: Jun. 22, 1999

[54] SYSTEM AND METHOD FOR EMBOSSING A PATTERN ON A CONSUMER PAPER PRODUCT

[75] Inventors: William H. Burgess, Wallingford; John P. Thelman, Downington, both of Pa.

[73] Assignee: Kimberly-Clark Worldwide, Inc., Neenah, Wis.

[21] Appl. No.: 08/397,408

[22] Filed: Mar. 2, 1995

[51] Int. Cl.[6] ..... B31B 1/36

[52] U.S. Cl. ..... 493/403; 493/467; 493/960; 162/109; 162/117; 162/362

[58] Field of Search ..... 162/109, 117, 162/361, 362; 427/361, 362, 278, 288; 493/396, 400, 401, 402, 403, 960, 467; 101/23, 24, 322, 822

[56] References Cited

U.S. PATENT DOCUMENTS

| | | | |
|---|---|---|---|
| 860,697 | 7/1907 | Scherf | 162/109 |
| 2,216,803 | 10/1940 | Benda | 162/117 |
| 2,940,891 | 6/1960 | Muller | 162/117 |
| 3,317,334 | 5/1967 | Norton | 427/278 |
| 3,323,983 | 6/1967 | Palmer | 162/117 |
| 3,868,205 | 2/1975 | Thomas | 425/363 |
| 4,183,300 | 1/1980 | Jamsidi | 101/24 |
| 4,189,344 | 2/1980 | Busker | 162/117 |
| 4,376,671 | 3/1983 | Schulz | 156/549 |
| 4,382,540 | 5/1983 | Eastman | 101/32 |
| 4,483,728 | 11/1984 | Bauernfeind | 156/209 |
| 4,671,983 | 6/1987 | Burt | 428/179 |
| 4,759,967 | 7/1988 | Bauernfeind | 428/154 |
| 4,921,034 | 5/1990 | Burgess et al. | 162/109 |
| 4,941,865 | 7/1990 | Skudrzyk | 493/467 |
| 5,036,758 | 8/1991 | Kobayashi | 493/467 |
| 5,269,983 | 12/1993 | Schulz | 364/25 |
| 5,356,506 | 10/1994 | McNeil | 493/467 |

FOREIGN PATENT DOCUMENTS

| | | |
|---|---|---|
| 666225 | 2/1952 | Switzerland . |
| WO94/23128 | 10/1994 | WIPO . |

*Primary Examiner*—James F. Coan
*Assistant Examiner*—Gene L. Kim
*Attorney, Agent, or Firm*—Gregory E. Croft

[57] ABSTRACT

An improved system for embossing a pattern on an absorbent consumer paper product such as a paper towel includes a first pair of embossing rollers that are patterned to impress a relatively fine preparatory base pattern onto the web, and a second pair of embossing rollers that are patterned to impress a final pattern onto the web. The final pattern is of a type that would cause bursting of the absorbent paper web if the absorbent paper web was passed through the second pair of embossing rollers without first being passed through the first set of embossing rollers. As a result, the formation of the preparatory base pattern by the first set of embossing rollers creates stretchability in the absorbent paper web that enables the final pattern to be impressed thereon by the second pair of embossing rollers without bursting the absorbent paper web.

18 Claims, 5 Drawing Sheets

SYSTEM AND METHOD FOR EMBOSSING A PATTERN ON A CONSUMER PAPER PRODUCT

BACKGROUND OF THE INVENTION

1. Field of the Invention

This invention relates generally to the field of absorbent consumer paper products, such as absorbent paper towels. More specifically, this invention relates to an improved method and system for embossing a pattern on an absorbent paper web that is less likely to cause the web to burst during embossing than was previously thought possible.

2. Description of the Related Technology

Absorbent consumer paper products such as the high quality paper towels, napkins and toilet tissue manufactured by Scott Paper Company are in wide use throughout the world.

In manufacturing such products, an absorbent base sheet is commonly embossed to increase the bulk of the product, improve product absorbency and roll building characteristics, and to create an attractive pattern on the product before it is packaged. Embossing can also aid in securing superposed plies of the absorbent web together. The standard embossing process in this industry involves passing the base sheet between a pair of rollers, at least one of which has a pattern thereon that is intended to be impressed onto the base sheet.

Unfortunately, stresses created in the base sheet during the embossing process can cause the web to rupture at certain stress concentration locations in a manner that the inventors hereof refer to as "bursting." Certain base sheet materials are more susceptible to bursting than others. For example, base sheets that have been re-creped (Single Re-Crepe or "SRC") or double re-creped ("DRC") present a relatively low risk of bursting because the re-crepeing process adds strength and stretchability to the base sheet. On the other hand, a heavy wet crepe base sheet such as that used in Scott Paper Company's SCOTTOWELS brand of paper towels is quite susceptible to bursting. In addition to the type of base sheet, the type of embossing pattern is an important factor in determining whether or not bursting occurs, because it is the embossing pattern that will determine where the locations of stress concentration will be and the intensity of stresses that will be created at each location. For example, embossing patterns that define pillow areas with continuous, substantially unbroken outer borders will create higher stresses within the pillow areas than patterns with broken borders because the tension created during embossing must be absorbed entirely within the pillow area, and cannot be passed onto any adjacent area. In addition, patterns with smaller pillow areas are more likely to cause bursting than larger pillow area patterns, because there is less area in a smaller pattern to absorb the tensions that are created during embossing. For example, for a heavy wet crepe type base sheet having a cross-direction stretch of 7% or less, the inventors have found that bursting is likely to occur. There is a category of pattern-material combinations, then, that the industry has not been able to achieve at consumer quality standards because of bursting problems. Unfortunately, many patterns that would otherwise be attractive to consumers are included in this category.

FIG. 1 is a photograph of a heavy wet crepe base sheet that has been embossed with a pattern of continuous intersecting lines to define diamond-shaped pillow areas. A typical heavy wet crepe base sheet may be defined as having a basis weight of 30 lbs/ream, a machine direction dry strength of 60 oz/in, a machine direction stretch of 11 percent, a cross direction strength of 45 oz/in, a cross direction stretch of 5 percent and a bulk of 200 (caliper of one sheet in mils×24,000). Clearly visible in FIG. 1 are a number of fractures in the base sheet that were caused by bursting during the embossing process. As may be seen from the photograph, bursting creates an unattractive blemish on the product, and weakens the product for consumer use.

It is clear that a need exists in this area of technology for a solution to the bursting problems that plague certain combinations of embossing patterns and base sheet materials.

SUMMARY OF THE INVENTION

Accordingly, it is an object of the invention to provide a solution to the bursting problems that plague certain combinations of embossing patterns and base sheet materials.

An improved method for embossing a pattern on an absorbent consumer paper product such as a paper towel includes, according to first aspect of the invention, steps of (a) transporting an absorbent paper web through a first pair of embossing rollers that are patterned to impress a relatively fine preparatory base pattern onto the web; and (b) passing the absorbent web having the preparatory base pattern impressed in step (a) thereon through a second pair of embossing rollers that are patterned to impress a final pattern thereon, the final pattern being of a type that would cause bursting of the absorbent paper web if the absorbent paper web was passed through said second pair of embossing rollers without first being passed through said first set of embossing rollers, whereby the formation of the preparatory base pattern formed in step (a) creates stretchability in the absorbent paper web that enables the final pattern to be impressed thereon without bursting the absorbent paper web.

According to a second aspect of the invention, an improved system for embossing a pattern on an absorbent consumer paper product such as a paper towel includes a first pair of embossing rollers that are patterned to impress a relatively fine preparatory base pattern onto the web; and a second pair of embossing rollers that are patterned to impress a final pattern onto the web, the final pattern being of a type that would cause bursting of the absorbent paper web if the absorbent paper web was passed through the second pair of embossing rollers without first being passed through the first set of embossing rollers, whereby the formation of the preparatory base pattern by the first set of embossing rollers creates stretchability in the absorbent paper web that enables the final pattern to be impressed thereon by the second pair of embossing rollers without bursting the absorbent paper web.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 2:
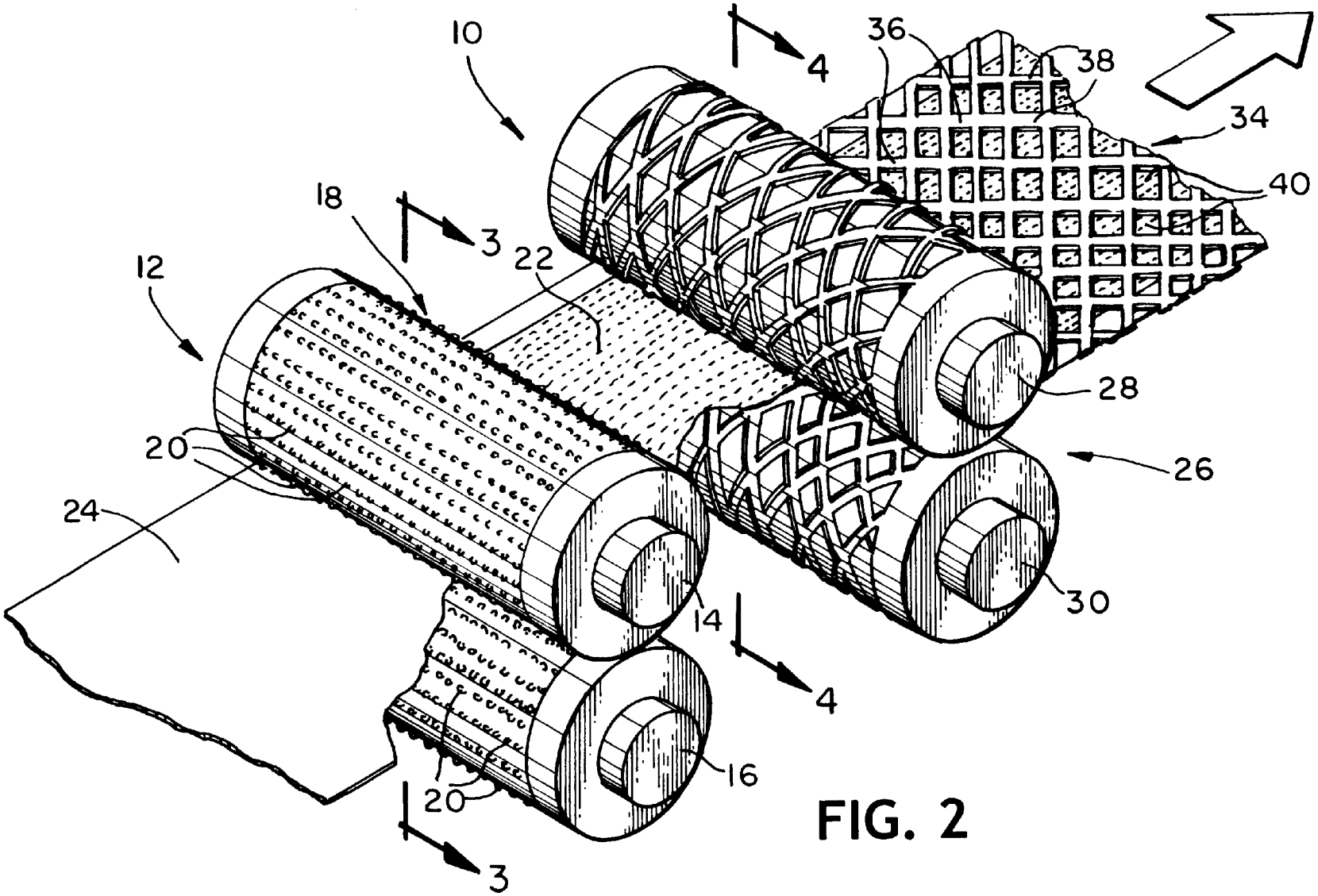
FIG. 2 is a diagrammatical view depicting an improved method and apparatus for embossing a pattern on a consumer paper product that is constructed according to a first preferred embodiment of the invention.
Figure 4:
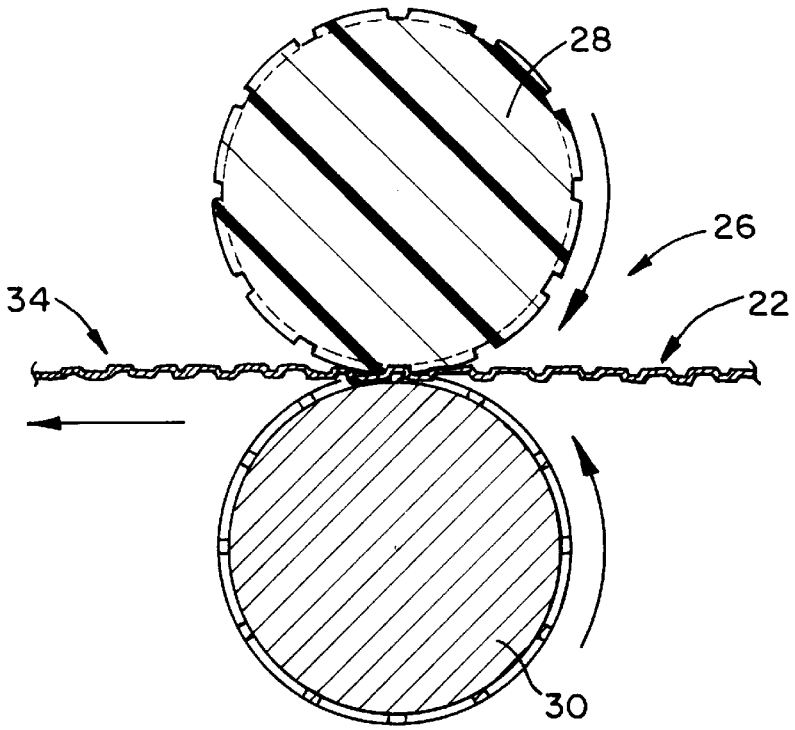
FIG. 4 is a cross sectional view taken along lines 4—4 in FIG. 2.
Figure 3:
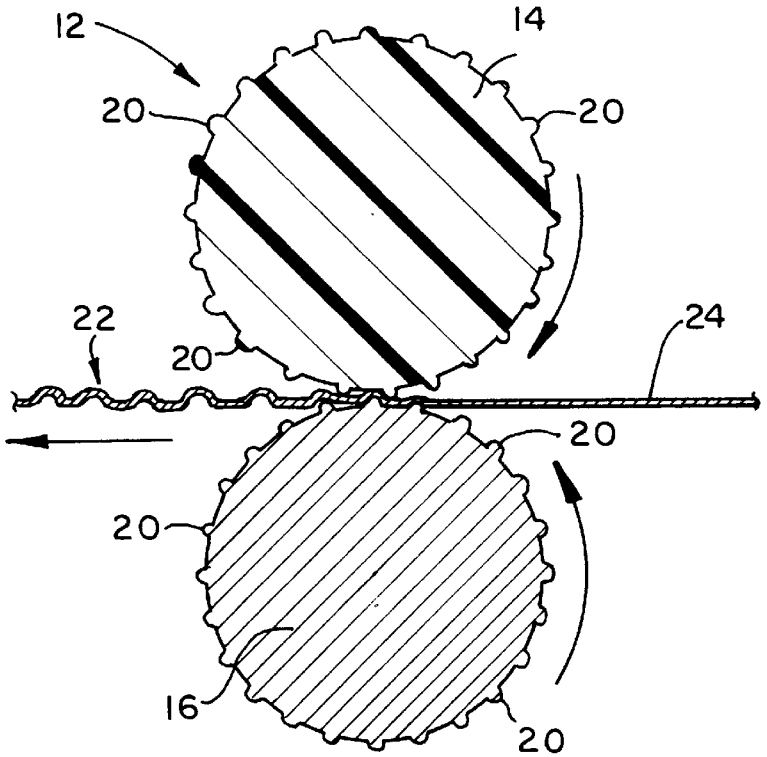
FIG. 3 is a cross sectional view taken along lines 3—3 in FIG. 2.
Figure 6:
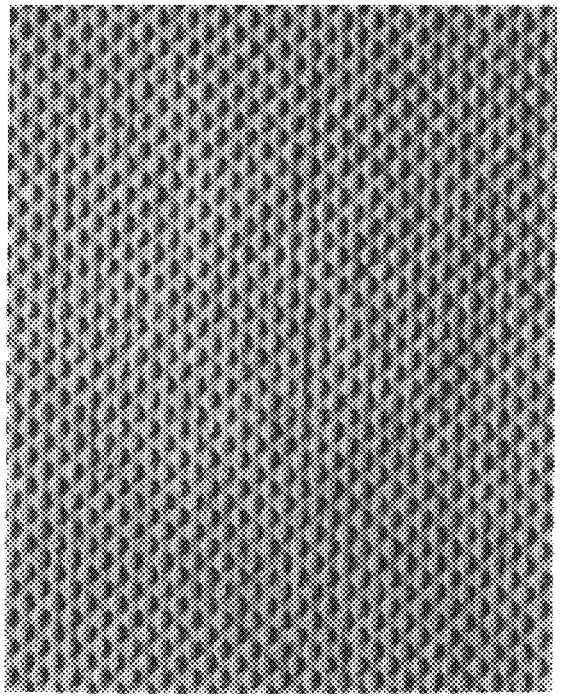
FIG. 6 is a photograph depicting the pattern formed on an absorbent paper web after it is passed through the first set of embossing rollers shown FIG. 2.

Referring now to the drawings, wherein like reference numerals designate corresponding structure throughout the views, and referring in particular to FIG. 2, an improved system 10 for embossing a pattern on an absorbent consumer paper product such as a paper towel includes a first pair 12 of embossing rollers that are shaped to impress a relatively fine preparatory base pattern on to the web 24. In the preferred embodiment, the first pair 12 of embossing rollers includes a first metallic roller 14 and a second metallic roller 16 that is substantially identical to first metallic roller 14 and has an array 18 of closely spaced pin like projections 20 projecting therefrom. Embossing rollers 14, 16 are thus patterned to impress a preparatory base pattern 22 onto the web 24 that is made up of a regular pattern of small, pin like displacements of the absorbent paper web 24. A photograph of the web 24 having the preparatory base pattern 22 formed thereon is provided as FIG. 6. Alternatively, rollers 14,16 could be fabricated from other materials, both rigid and flexible, as is well known in this area of technology. In the most preferred embodiment, the pin-like displacements are concentrated at a density of between 35 per square inch to 400 per square inch and are from between 0.015 to 0.08 inches in diameter.

Figure 5:
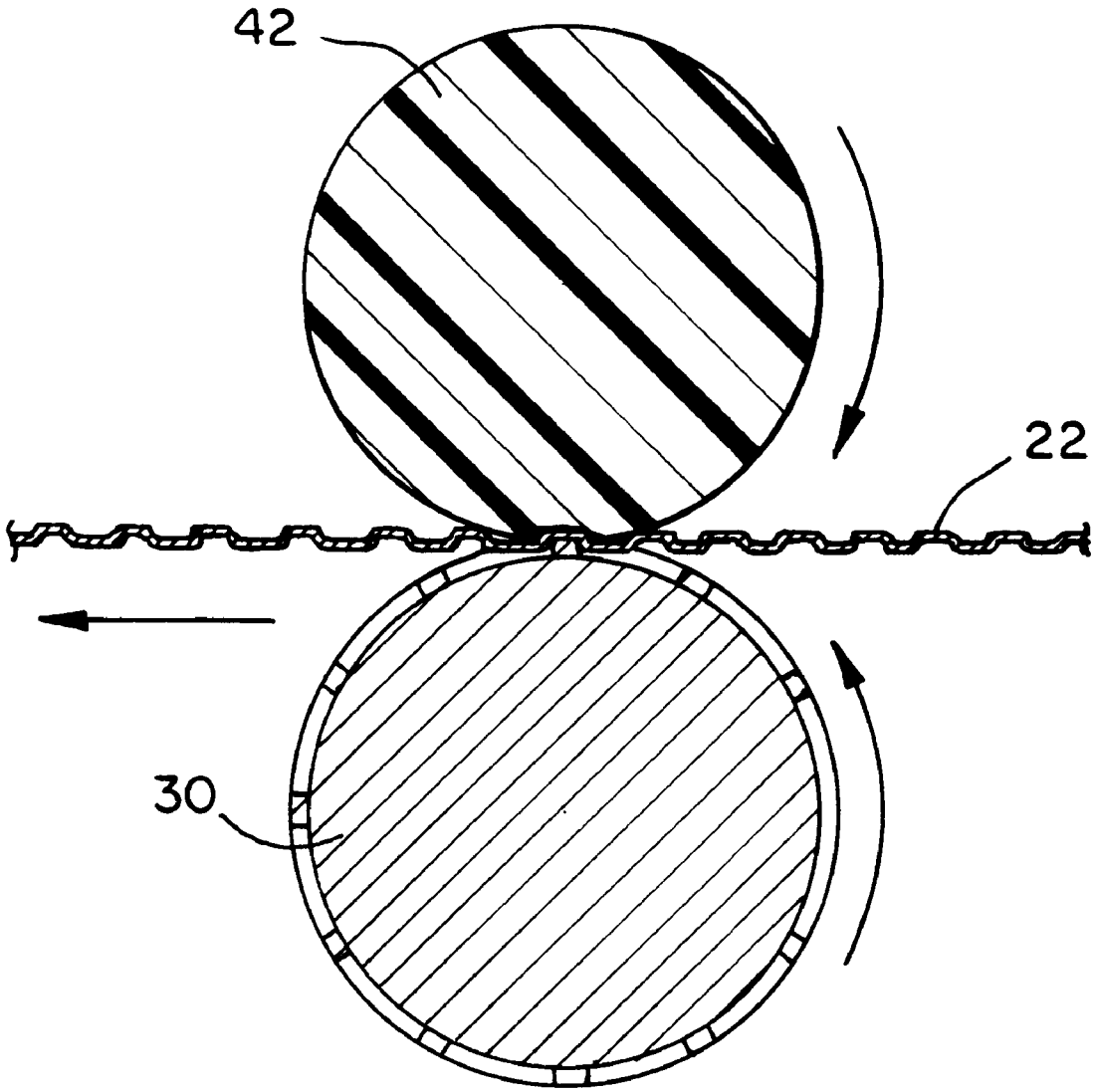
FIG. 5 is a view, similar to FIG. 4, depicting a portion of the apparatus that is constructed according to a second preferred embodiment of the invention.

The purpose of the preparatory base pattern 22 is to impart additional stretchability to the absorbent paper web 24 before a final pattern 34 is embossed onto the web 24. A second pair 26 of embossing rollers is shown in FIG. 2 for embossing the final pattern 34 onto the absorbent paper web 24 on top of the preparatory base pattern 22. Second pair of rollers 26 includes, according to the preferred embodiment of the invention, a third rubber roller 28 and a fourth metallic roller 30. In the preferred embodiment, metallic roller 30 has a number of crisscrossing linear recesses 32 defined therein, and rubber roller 28 has a corresponding pattern of male projections extending therefrom that are designed to mate with the linear recesses 32 in fourth roller as the rollers 28, 30 are turned during operation. According to a second, also preferred embodiment of the invention, a third rubber roller 42 that has a flat outer surface could alternatively be used in conjunction with the fourth metallic roller 30. This embodiment of the invention is shown in cross section in FIG. 5. Alternatively, third and fourth rollers could be fabricated from other materials, both rigid and flexible, as is well known in the field. Both pairs of rollers could alternatively be provided so as to be male/female, female/resilient, male/resilient or hermaphroditic, as is known in the technology. The roller pairs might also be configured so as to share a roller, meaning that there would be three nip rolls instead of four; this is considered to include two pairs of rollers as defined herein.

As may be seen in FIG. 2, the final pattern 34 includes a first set of continuous lines 36 that are parallel to each other and are diagonal to both the cross direction and machine direction of the absorbent paper web 24. The final pattern 34 further includes a second set 38 of continuous lines that are orthogonal to the first set of lines 36. The two sets of lines 36, 38 together define a matrix of polygonal pillow like areas in the web 24 that are, in the preferred embodiment, diamond shaped. It is to be understood that the invention is not limited to the pattern shown in FIG. 2, but may be applied to the entire category of pattern-material combinations that the industry has not been able to achieve at consumer quality standards because of bursting problems.

Preferably, the preparatory base pattern 22 will include at least one projection that is defined in the web 24 at the intended location of each pillow like area 40 in the final pattern 34 to impart flexibility to each pillow like area 40 that will prevent bursting of the web 24 in the pillow like area 40 as the final pattern 34 is embossed onto the web 24. As many as one hundred projections could be included in the intended location of each pillow. In addition, the second pattern applied by the second pair of rollers will preferably have a depth that is between 3–12 times that of the pattern applied by the first set of rollers. The pattern shown in FIG. 6 has been found to increase the cross-direction stretch characteristics of the web from its original 3–7% or less to 7–11%. Accordingly, the additional stretchability created by the perparatory embossing step is utilized to create additional bulk in the pillowing process, without bursting or adversely affecting the appearance or strength of the product.

Figure 1:
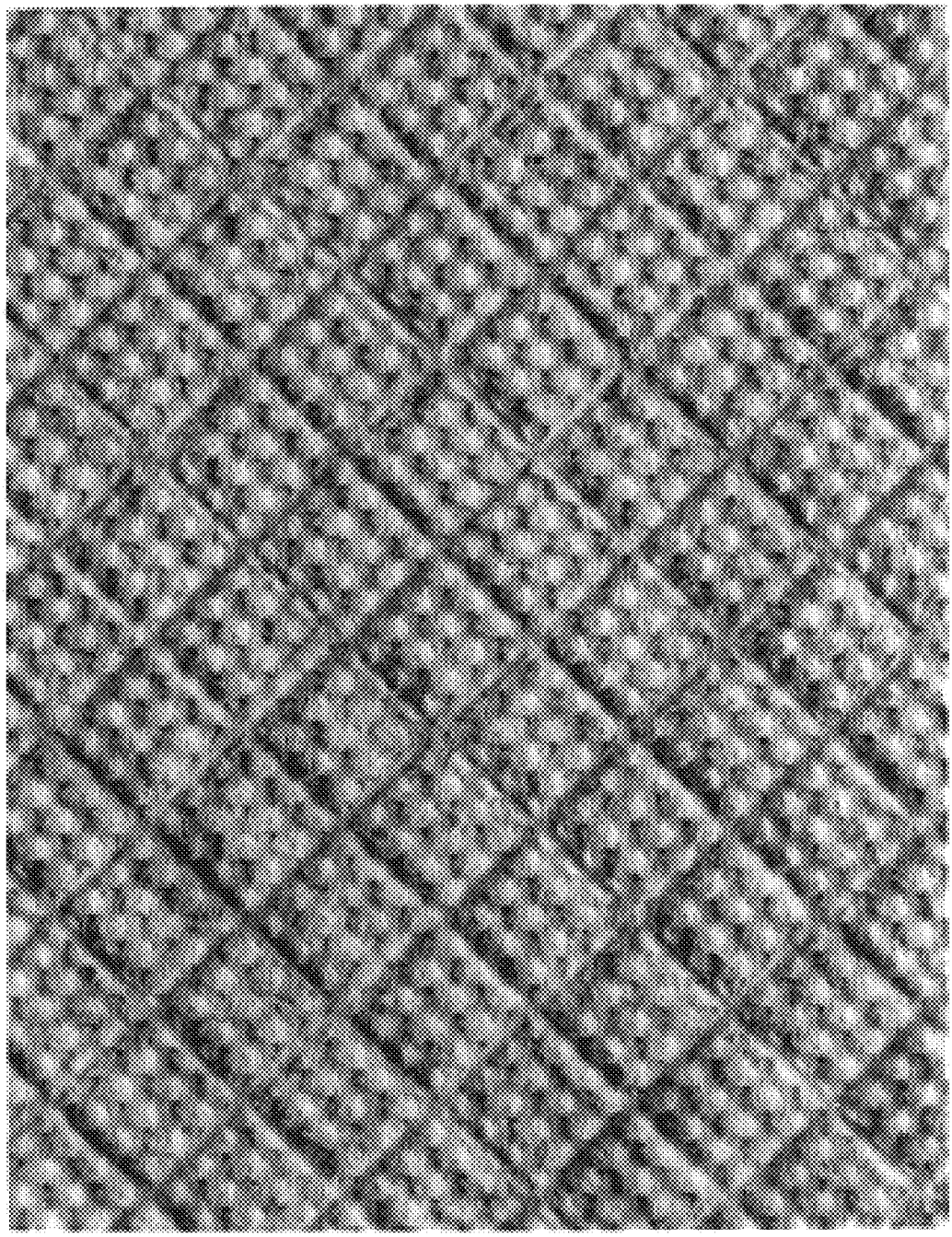
FIG. 1 is a photograph depicting the degree of bursting that occurs in an absorbent paper web when embossed with the pattern shown in the second set of rollers in FIG. 2 without any preliminary preparation steps.
Figure 7:
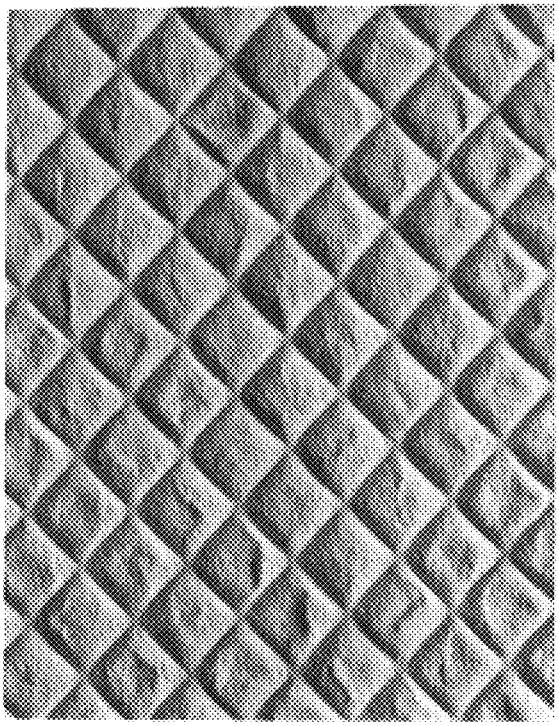
FIG. 7 is a photograph depicting the final pattern on the base sheet after it has been passed through both sets of embossing rollers shown in FIG. 2.

FIG. 7 is a photograph that depicts the final pattern 34 on a actual absorbent paper web 24. The diamond shaped pattern in the photograph of FIG. 7 was embossed with the same roller set that was used to embossed the base sheet shown in FIG. 1, under the same conditions, except for the present of the preparatory base pattern 22 in the web shown in FIG. 7. A comparison of FIG. 1 and 7 will reveal that the sample shown in FIG. 1 is replete with small fractures in the web as a result of bursting. In contrast, the web shown in FIG.7 is relatively free of such fractures, and has an attractive pattern formed thereon. The pattern shown in FIG. 7, with the small pillow like areas defined by unbroken or essentially unbroken borders, creates a soft, pillowy texture that would not have been achievable at commercial quality levels were it not for the preparatory step described above.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved method for embossing a pattern on an absorbent consumer paper product such as a paper towel, comprising the steps of:

(a) transporting an absorbent paper web through a first pair of embossing rollers that are patterned to impress a relatively fine preparatory base pattern onto the web, said base pattern containing 35 to 400 pin-like displacements per square inch; and (b) passing the absorbent web having the preparatory base pattern impressed in step (a) thereon through a second pair of embossing rollers that are patterned to impress a second pattern over the preparatory base pattern, said second pattern defining pillow-like areas which contain from 1 to 100 of the pin-like displacements.

2. The method according to claim 1 wherein said first pair of embossing rollers are both metallic, and both include similar patterns of pin-like projections thereon.

3. A method according to claim 1, wherein the second pattern includes a number of intersecting continuous lines that define pillow-like areas that have a substantially unbroken outer border, and said preparatory base pattern includes at least one projection that is defined in the web at an intended location of each pillow-like area to impact flexibility to the web during step (b), whereby the web will be prevented from bursting in the pillow-like area during step (b).

4. The method according to claim 3, wherein the second pattern includes a first set of unbroken parallel lines, and a second set of unbroken parallel lines that intersect the first set of unbroken parallel lines to define a regular pattern of polygonal pillow-like areas in the web.

5. A method according to claim 4, wherein the first and second sets of lines are oriented so as to define a regular pattern of diamond-shaped pillow-like areas in the web.

6. A method according to claim 1, wherein step (b) is performed with a second set of embossing rollers that comprises one metallic roller and one resilient elastomeric roller.

7. A method according to claim 6, wherein the metallic roller has a female embossing pattern defined therein.

8. A method according to claim 6, wherein the elastomeric roller has a substantially flat outer surface.

9. A method according to claim 7, wherein the elastomeric roller has a male pattern defined thereon that is configured to mate with said female pattern on said metallic roller.

10. An improved system for embossing a pattern on a web of an absorbent consumer paper product such as a paper towel, comprising:

a first pair of embossing rollers configured to impress a relatively fine preparatory base pattern onto the web, said base pattern containing 35 to 400 pin-like displacements per square inch; and a second pair of embossing rollers configured to impress a second pattern onto the web, such that the second pattern defines pillow-like areas in the web which contain from 1 to 100 of the pin-like displacements.

11. A system according to claim 10, wherein said first pair of embossing rollers are both metallic, and both include similar patterns of pin-like projections thereon.

12. A system according to claim 10, wherein the second pattern includes a number of intersecting continuous lines that define pillow-like areas that have a substantially unbroken outer border, and said preparatory base pattern imparts flexibility to the web, whereby the web will be prevented from bursting in the pillow-like area.

13. A system according to claim 12, wherein the second pattern includes a first set of unbroken parallel lines, and a second set of unbroken parallel lines that intersect the first set of unbroken parallel lines to define a regular pattern of polygonal pillow-like areas in the web.

14. A system according to claim 13, wherein the first and second sets of lines are oriented so as to define a regular pattern of diamond-shaped pillow-like areas in the web.

15. A system according to claim 10, wherein said second set of embossing rollers comprises one metallic roller and one resilient elastomeric roller.

16. A system according to claim 15, wherein the metallic roller has a female embossing pattern defined therein.

17. A system according to claim 15, wherein the elastomeric roller has a substantially flat outer surface.

18. A system according to claim 16, wherein the elastomeric roller has a male pattern defined thereon that is configured to mate with said female pattern on said metallic roller.

* * * * *